US009409436B2

(12) United States Patent
Warmus

(10) Patent No.: US 9,409,436 B2
(45) Date of Patent: Aug. 9, 2016

(54) BINDER APPARATUS

(71) Applicant: R.R. DONNELLEY & SONS COMPANY, Chicago, IL (US)

(72) Inventor: James Warmus, La Grange, IL (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 210 days.

(21) Appl. No.: 14/162,447

(22) Filed: Jan. 23, 2014

(65) Prior Publication Data

US 2014/0205362 A1 Jul. 24, 2014

Related U.S. Application Data

(60) Provisional application No. 61/756,434, filed on Jan. 24, 2013.

(51) Int. Cl.
*B42F 13/20* (2006.01)
*B42F 13/22* (2006.01)
*B42F 13/26* (2006.01)

(52) U.S. Cl.
CPC ..... *B42F 13/26* (2013.01); *B42F 13/20* (2013.01); *B42F 13/22* (2013.01)

(58) Field of Classification Search
CPC ..... B42F 13/20; B42F 13/22; B42F 13/26
USPC ..... 402/26, 30–31, 36–38, 41
See application file for complete search history.

(56) References Cited

U.S. PATENT DOCUMENTS

| | | | | |
|---|---|---|---|---|
| 2002/0122687 | A1* | 9/2002 | Horn | B42F 13/26 402/16 |
| 2005/0013654 | A1* | 1/2005 | Cheng | B42F 13/26 402/36 |
| 2006/0088364 | A1* | 4/2006 | Whaley | B42F 13/26 402/38 |
| 2011/0170942 | A1* | 7/2011 | Huang | B42F 13/26 402/31 |

* cited by examiner

*Primary Examiner* — Kyle Grabowski
(74) *Attorney, Agent, or Firm* — Hanley, Flight & Zimmerman, LLC

(57) ABSTRACT

Binder apparatus are disclosed. An example binder apparatus includes a housing, first and second carrier rails supported by the housing and a slider movable between a first position and a second position. In the first position, the slider to secure the first and second carrier rails in a closed position. In the second position, the slider to enable pivotable movement of the first and second carrier rail. The binder apparatus includes a lever to pivot the first carrier rail and the second carrier rail. The lever includes a groove and a channel. The groove to receive a portion of the first and second carrier rails, the channel to receive an end of the slider. The end of the slider to move within the channel to delay movement of the slider when the lever pivots the first and second carrier rails from the open position toward the closed position.

20 Claims, 22 Drawing Sheets

BINDER APPARATUS

RELATED APPLICATION

This patent claims priority to U.S. Provisional Patent Application No. 61/756,434, filed Jan. 24, 2013, which is hereby incorporated herein by reference in its entirety.

FIELD OF THE DISCLOSURE

This patent relates to binders and, more specifically, to binder apparatus.

BACKGROUND

Binders are used to store loose leaf pages, documents, other materials, etc.

DETAILED DESCRIPTION

Figure 1:
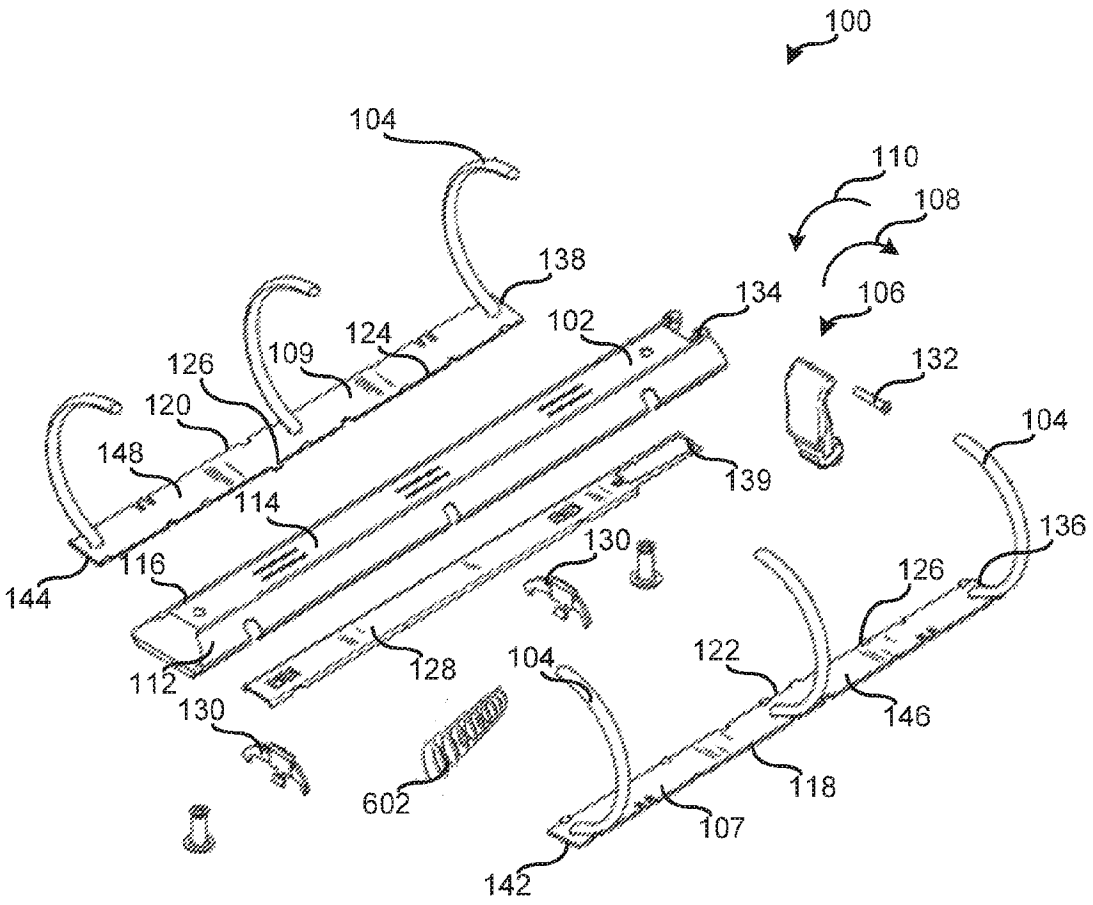
FIG. 1 depicts an exploded view of an example binder apparatus.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples disclosed herein relate to binder apparatus that enable closure members/rings to be relatively easily transitioned and/or secured in either an open position or a closed position. More specifically, the examples disclosed herein relate to example travel bars and/or levers that enable a lever to pivot and transition carrier rails from the open position to the closed position prior to moving a travel bar. The travel bar is used to lock and/or secure the binder apparatus in the closed position and/or unlock and/or enable the binder apparatus to move toward and be in the open position. In contrast to some known examples, the example binder apparatus may not include an intermediate connector(s) between the lever and the travel bar to enable travel bar movement delay. In some examples, to enable the lever to move without causing corresponding movement of the travel bar, the travel bar includes an opening, slot and/or loop including a portion received in a channel (e.g., arcuate channel) of the lever.

In operation, when the lever begins to transition the rings from the closed position to the open position, a leading edge of the channel substantially immediately engages the travel bar portion positioned within the channel and moves and/or pulls the travel bar and/or its locking mechanism to unblock the movement of the carrier rails and enable the rings to open. The channel is sized and/or has a length to enable the lever to transition the carrier rails from the fully open position toward the fully closed position prior to the travel bar being moved. Specifically, the lever may be moved from the fully open position toward the closed position a substantial distance prior to a trailing edge of the channel engaging the travel bar portion positioned within the channel. Moving the lever without moving the travel bar enables the carrier rails to be transitioned from the open position toward the closed and/or secured position prior to the travel bar moving, which substantially prevents the binder apparatus from malfunctioning (e.g., jamming, binding, etc.). In some examples, a spring and/or biasing apparatus is used to move the travel bar from the unsecured position toward and/or into the secured position. In some such examples, after the pivoting of the carrier rails creates a substance space between the pivot axis of the carrier rails and the inner housing surface, the biasing element moves the travel bar and its blocking element toward the blocking position (e.g., the blocking elements are positioned in the space created between the inner housing surface and the carrier rails). The spring may be coupled between the binder housing and the travel bar or otherwise coupled to bias the travel bar.

The channel, which may have different shapes, may be positioned above and/or below the pivot point of the lever. For example, the channel may have an arcuate shape, a linear shape, an inverted arcuate shape, a linear and/or curvilinear shape, etc. If the channel has an arcuate shape, the channel may reduce vertical and/or pivoting motion of the travel bar as the lever rotates through the open and closed positions. If the channel has a linear shape, the channel may change the vertical position of the travel bar when the lever is pivoted. If the channel has an inverted arcuate shape, the channel may further increase vertical displacement of the travel bar.

In some examples, to enable an end of the travel bar (e.g., a loop end) to be coupled to the lever, the lever defines a slot coupled to the channel. The slot may include a lip adjacent an entrance of the channel and/or may have an entrance and/or exit shape to substantially prevent the travel bar from inadvertently exiting the channel. In other examples, the slot is sized (e.g., a smaller size) to require a particular amount of force to move the travel bar portion into the slot. In some examples, the slot may be positioned at a distance from and/or at an alternative location relative to the channel to minimize the possibility of inadvertently removing the travel bar from the channel.

FIG. 1 depicts an example binder apparatus 100 that can be used to store loose leaf pages, documents, other materials, etc. The binder 100 may include a housing 102, one or more associated closure members and/or ring portions 104 and a lever and/or lever/actuating assembly 106. The ring portions 104 are coupled to a first carrier rail 107 and a second carrier rail 109 to form a closure (e.g., a ring) that enables documents to be stored within the binder 100. The ring portions 104 may be different than depicted in FIG. 1. For example, the ring portions 104 may be differently shaped, different from one another, etc.

To open and/or close the ring portions 104, the lever 106 may be actuated in a direction generally represented by arrows 108, 110. Specifically, to open the ring portions 104, the lever 106 is moved in a direction generally indicated by the arrow 108, and to close the ring portions 104, the lever 106 is moved in a direction generally indicated by the arrow 110. However, the lever 106 may be differently configured to open and/or close the ring portions 104.

The housing 102 includes a first side and/or portion 112, a second and/or central portion 114 and a third side and/or portion 116. The second portion 114 is coupled to and positioned between the first and third sides 112, 116. The carrier rails 107, 109 are positioned within the housing 102 such that a first longitudinal edge 118 of the first carrier rail 107 is biased by the first side 112 and a second longitudinal edge 120 of the second carrier rail 109 is biased by the third side 116. Third and fourth longitudinal edges 122, 124 of the carrier rails 107, 109 may be pivotably coupled via tabs 126.

Figure 2:
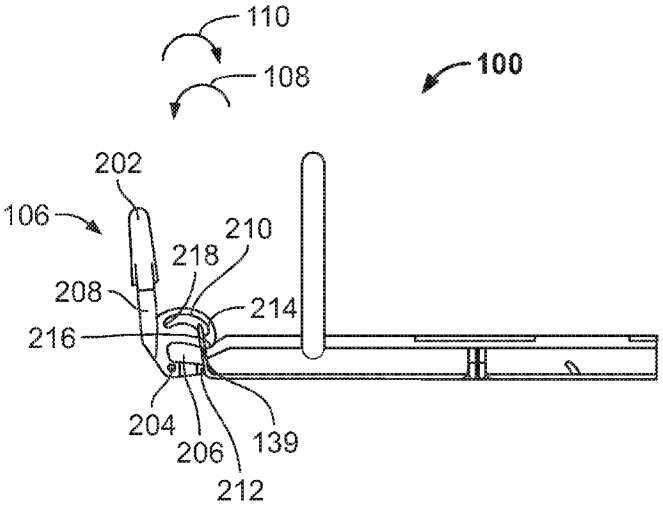
FIG. 2 depicts a side view of the example binder apparatus in the closed position.
Figure 4:
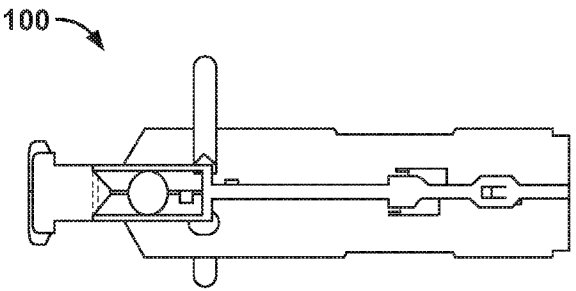
FIG. 4 depicts a bottom view of the example binder apparatus in the closed position.
Figure 7:
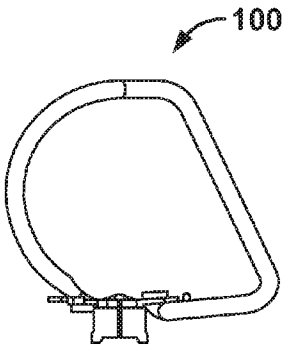
FIGS. 6 and 7 depict side and end views of the example binder apparatus in the closed position.
Figure 9:
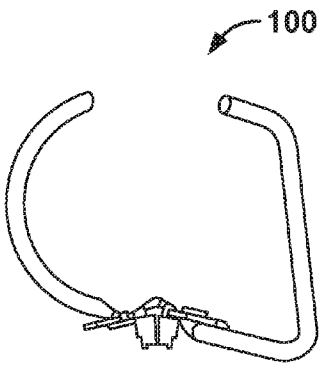
FIGS. 8 and 9 depict side and end views of the example binder apparatus in the open position.

To enable the binder 100 to be opened and closed, the binder 100 includes the lever 106, a travel bar 128 and locking elements 130. As shown in FIG. 2, the lever 106 includes a handle 202, a first aperture 204, a groove, second aperture and/or beak 206, a slot 208 and/or a channel 210. A pin 132 (FIG. 1) is received in the first aperture 204 and apertures 134 (FIG. 1) of the housing 102 (FIG. 1) to pivotably couple the lever 106 to the housing 102. Ends 136, 138 (FIG. 1) of the carrier rails 107, 109 are positioned in the channel 210 to enable movement of the handle 202 to in turn transition and/or assist in transitioning the carrier rails 107, 109 between the open and closed positions. A travel bar portion and/or end 139 is positioned in the channel 210 via the slot 208.

Figure 3:
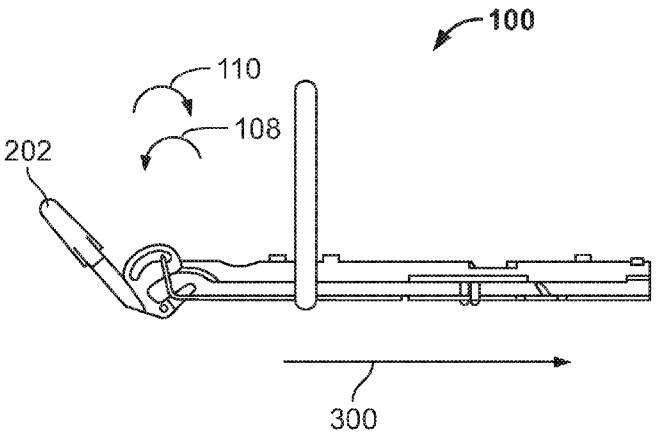
FIG. 3 depicts a side view of the example binder apparatus in the open position.
Figure 5:
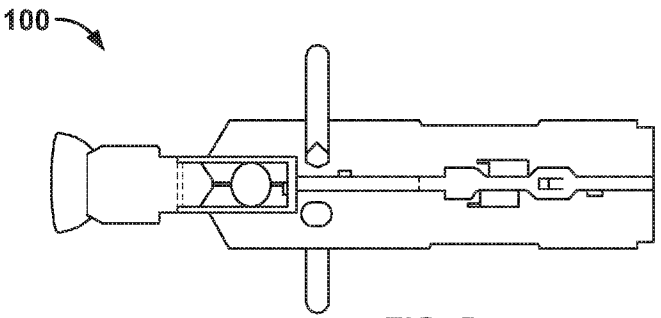
FIG. 5 depicts a bottom view of the example binder apparatus in the open position.

In operation as shown in FIGS. 1-3, to open the binder 100, the handle 202 is moved in a direction generally indicated by the arrow 108, thereby moving a first end 212 of the beak 206 toward outward facing surfaces 142, 144 of the carrier rails 107, 109. When the first end 212 begins to transition the carrier rails 107, 109 from the closed position to the open position, the travel bar end 139 is positioned adjacent a leading edge and/or surface 214 of the channel 210. As the handle 202 is further pivoted in the direction generally indicated by arrow 108, the travel bar 128 and its locking elements 130 are moved and/or transitioned toward an unblocking position. Specifically, the locking elements 108, which are positioned between the travel bar 128 and the carrier rails 107, 109, are moved and/or pivoted via the longitudinal movement of the travel bar 128 to enable and/or not block the carrier rails 107, 109 from pivoting toward the open position (e.g., the locking elements 130 are non-perpendicularly positioned relative to the central portion 114).

Figure 6:
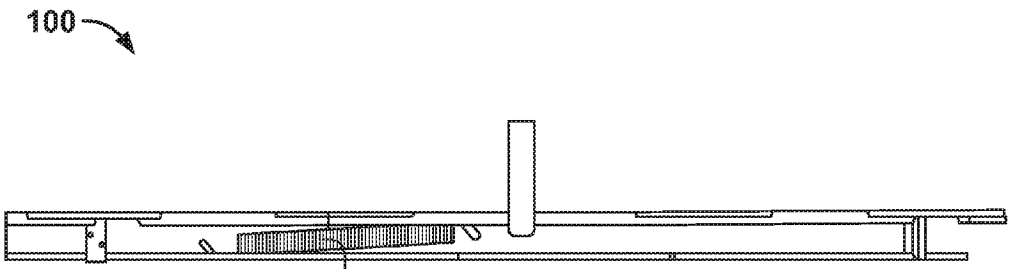
Figure 8:
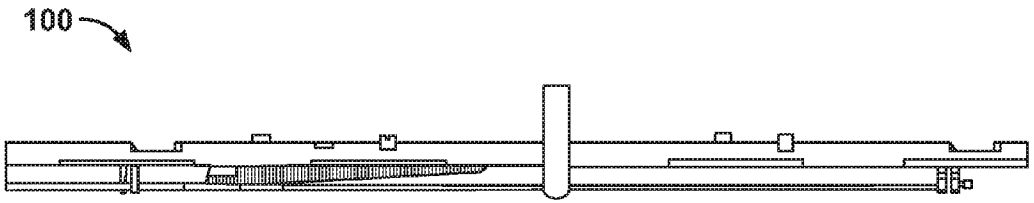

To close the binder 100 as shown in FIG. 1-3, the handle 202 is moved in a direction generally indicated by arrow 110, thereby moving a second end 216 of the beak 206 toward inward facing surfaces 146, 148 of the carrier rails 107, 109. In some examples, the channel 210 is sized and/or has a length to enable the second end 216 to engage and transition the carrier rails 107, 109 toward the closed position prior to the travel bar end 139 engages a trailing edge 218 of the channel 210. After the travel bar end 139 engages the trailing edge 218, in some examples, further movement of the handle 202 in the direction generally indicated by arrow 110 moves and/or transitions the travel bar 128 and the locking elements 130 toward the blocking position. Additionally or alternatively, in some examples, the travel bar 128 is biased via a spring and/or biasing apparatus 602 (FIG. 6) in a direction generally indicated by arrow 300 (FIG. 3). In some such examples, once the carrier rails 107, 109 are transitioned enough to provide adequate space between the travel bar 128 and the carrier rails 107, 109 to enable the locking elements 130 to be transitioned to the locking position (e.g., substantially perpendicular relative to the central portion 114), the spring 602 moves the travel bar 128 toward and/or into the locking position. In the blocking position, the locking elements 130 may be substantially perpendicularly positioned relative to the carrier rails 107 and/or 109 and/or the travel bar 128 to substantially prevent the binder 100 from opening.

Figure 10:
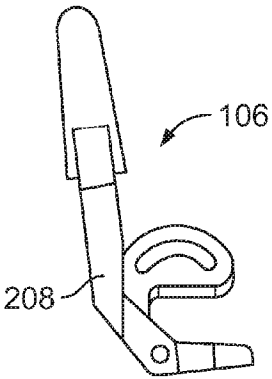
FIG. 10 depicts a perspective view of an example lever that can be used to implement the examples disclosed herein.
Figure 11:
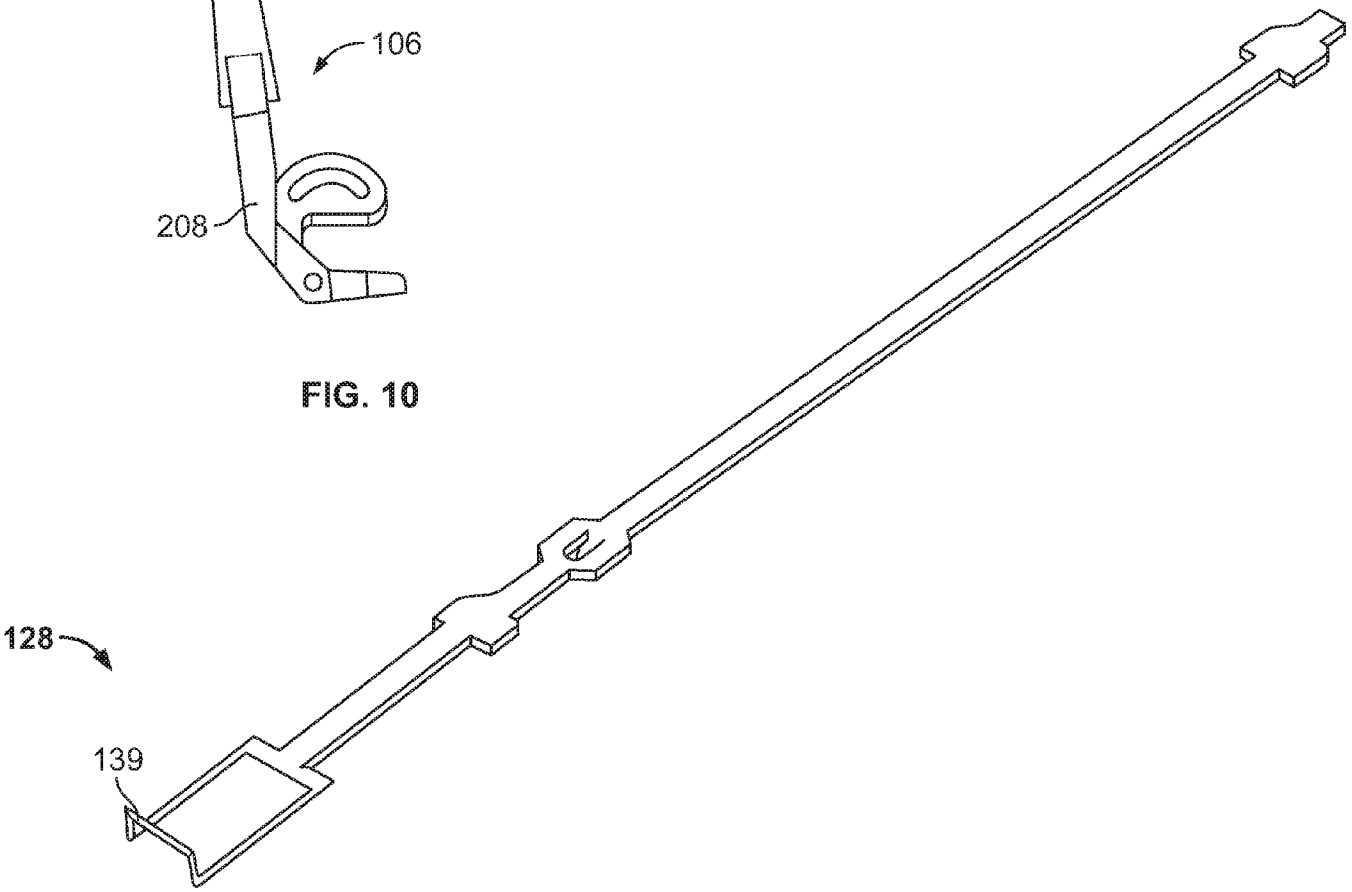
FIG. 11 depicts an example travel bar that can be used to implement the examples disclosed herein.

FIGS. 2, 4, 6 and 7 depict the binder apparatus 100 in the closed and/or secured position. FIGS. 3, 5, 8 and 9 depict the binder apparatus 100 in the open and/or unsecured position. FIG. 10 depicts a detailed view of the lever 106 and FIG. 11 depicts a detailed view of the travel bar 128.

Figure 12:
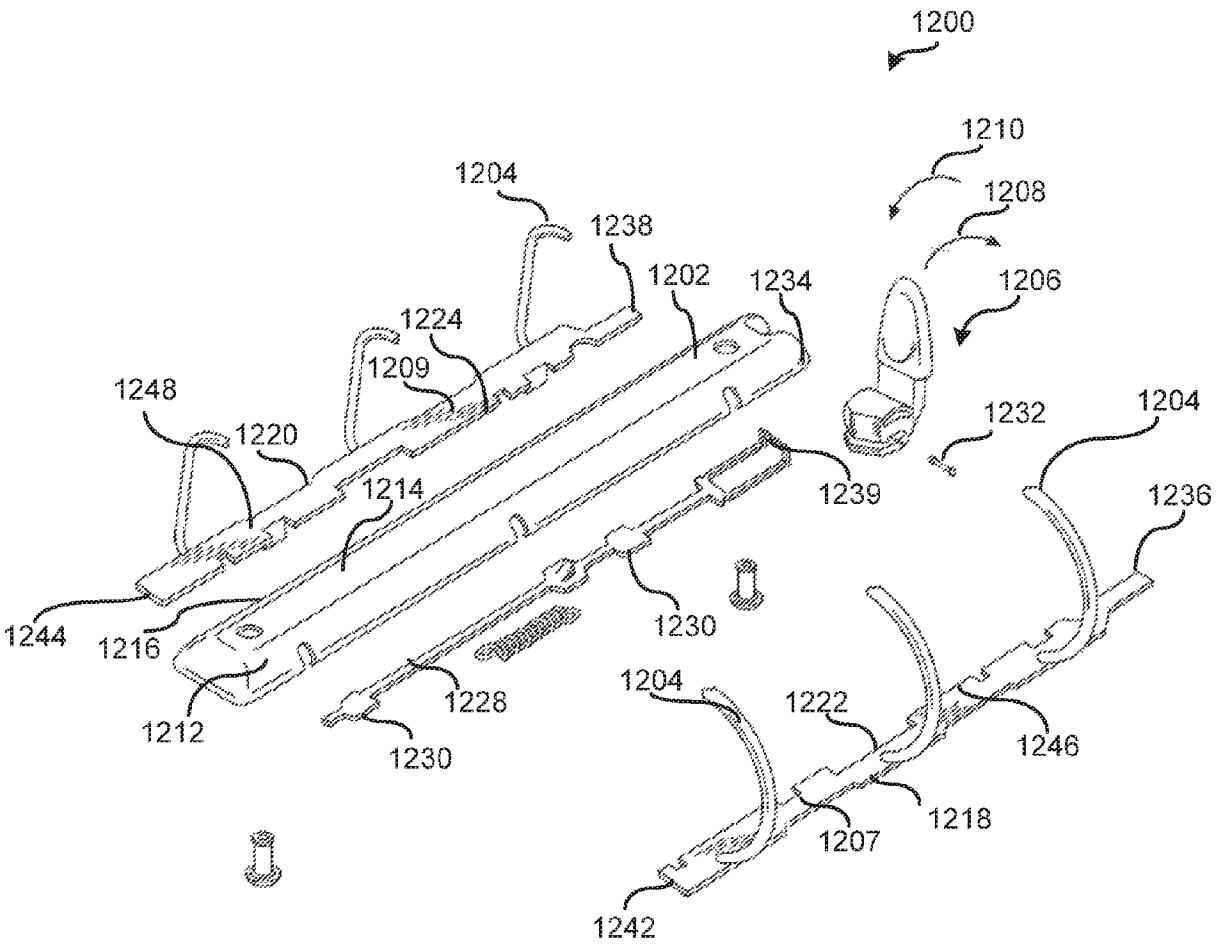
FIG. 12 depicts an exploded view of an example binder apparatus.

FIG. 12 depicts an example binder apparatus 1200 that can be used to store loose leaf pages, documents, other materials, etc. The binder 1200 may include a housing 1202, one or more associated closure members and/or ring portions 1204 and a lever and/or lever/actuating assembly 1206. The ring portions 1204 are coupled to a first carrier rail 1207 and a second carrier rail 1209 to form a closure (e.g., a ring) that enables documents to be stored within the binder 1200. The ring portions 1204 may be different than depicted in FIG. 12. For example, the ring portions 1204 may be differently shaped, different from one another, etc.

To open and/or close the ring portions 1204, the lever 1206 may be actuated in a direction generally represented by arrows 1208, 1210. Specifically, to open the ring portions 1204, the lever 1206 is moved in a direction generally indicated by the arrow 1208, and to close the ring portions 1204, the lever 1206 is moved in a direction generally indicated by the arrow 1210. However, the lever 1206 may be differently configured to open and/or close the ring portions 1204.

The housing 1202 includes a first side and/or portion 1212, a second and/or central portion 1214 and a third side and/or portion 1216. The second portion 1214 is coupled to and positioned between the first and third sides 1212, 1216. The carrier rails 1207, 1209 are positioned within the housing 1202 such that a first longitudinal edge 1218 of the first carrier rail 1207 is biased by the first side 1212 and a second longitudinal edge 1220 of the second carrier rail 1209 is biased by the third side 1216. Third and fourth longitudinal edges 1222, 1224 of the carrier rails 1207, 1209 may be pivotably coupled via tabs.

Figure 13:
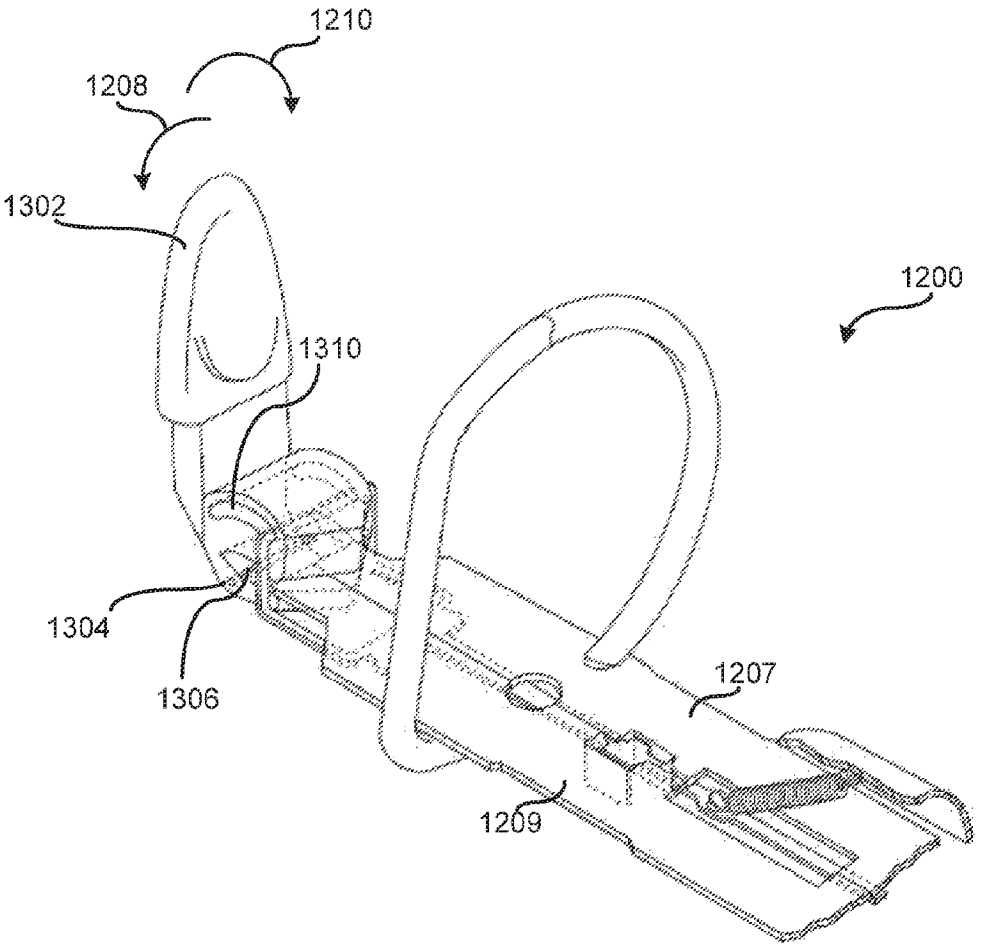
FIGS. 13-15 depict the example binder apparatus of FIG. 12 in the closed position.

To enable the binder 1200 to be opened and closed, the binder 1200 includes the lever 1206, a travel bar 1228 and locking elements 1230. As shown in FIG. 13, the lever 1206 includes a handle 1302, a first aperture 1304, a groove, second aperture and/or beak 1306 and/or a channel 1310. A pin 1232 (FIG. 12) is received in the first aperture 1304 and apertures 1234 (FIG. 12) of the housing 1202 (FIG. 12) to pivotably couple the lever 1206 to the housing 1202. Ends 1236, 1238

(FIG. 12) of the carrier rails 1207, 1209 are positioned in the channel 1310 to enable movement of the handle 1302 to in turn transition and/or assist in transitioning the carrier rails 1207, 1209 between the open and closed positions. A travel bar portion and/or end 1239 is positioned in the channel 1310 via, for example, a slot or other means.

Figure 14:
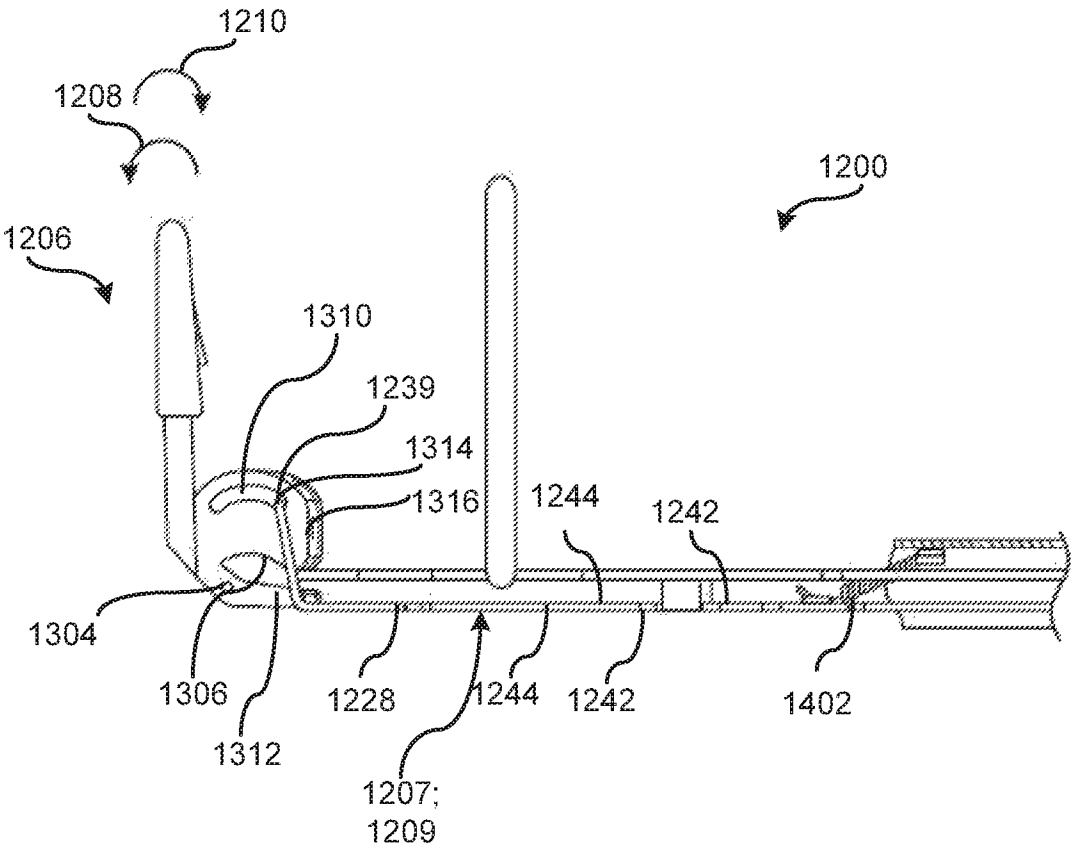
Figure 15:
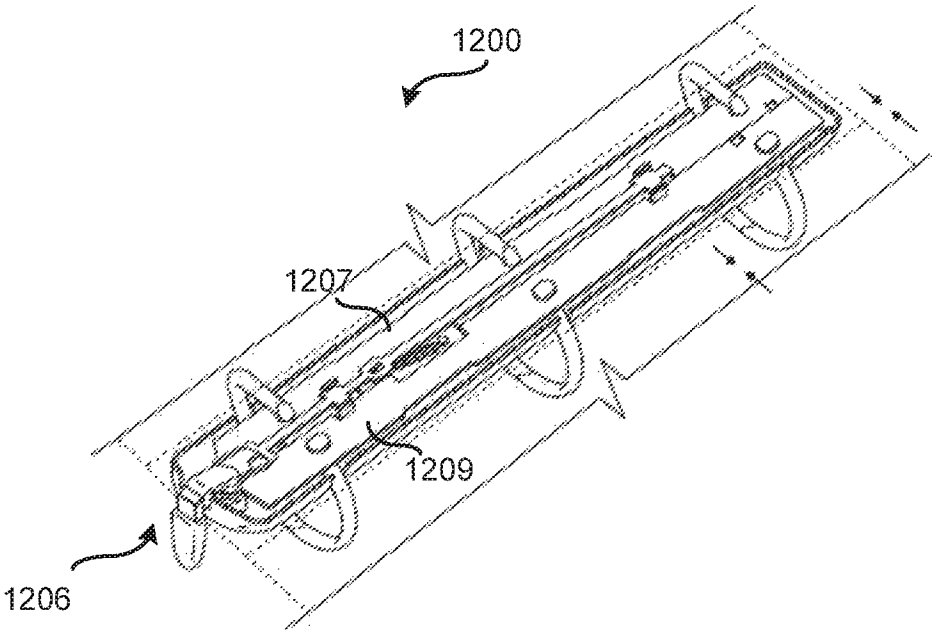
Figure 16:
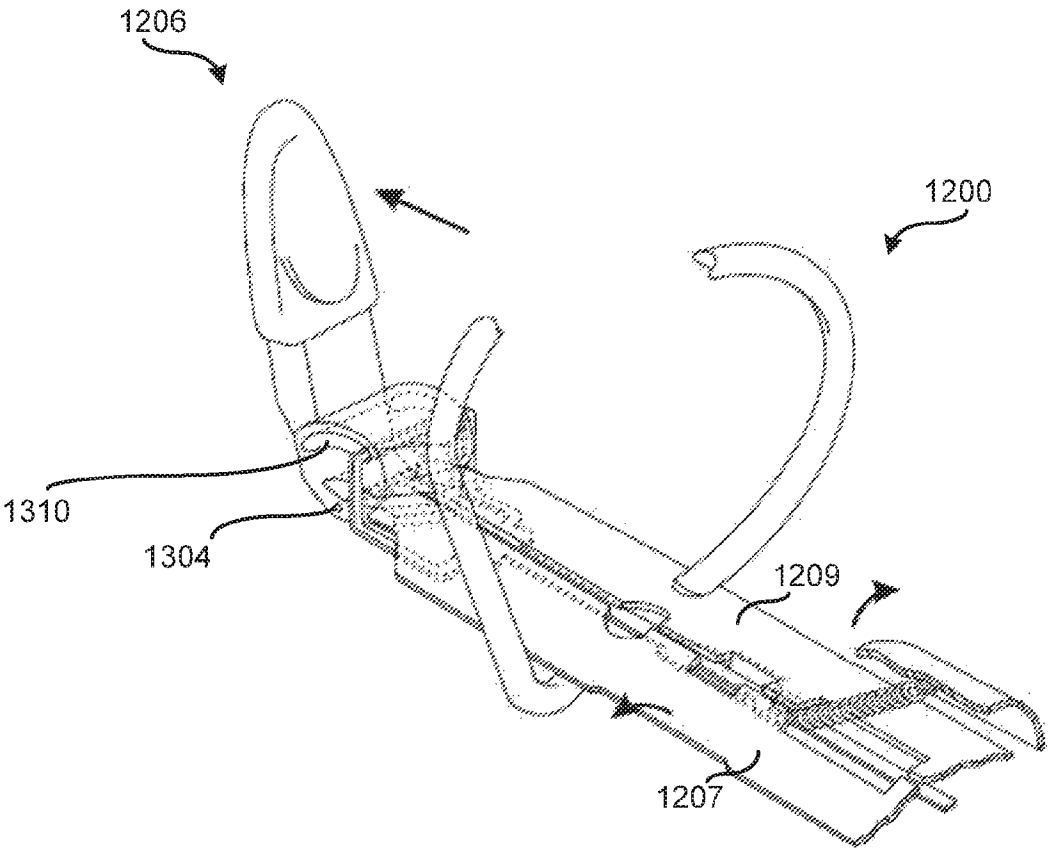
FIGS. 16-18 depict the example binder apparatus of FIG. 12 being transitioned from the closed position to the open position.
Figure 17:
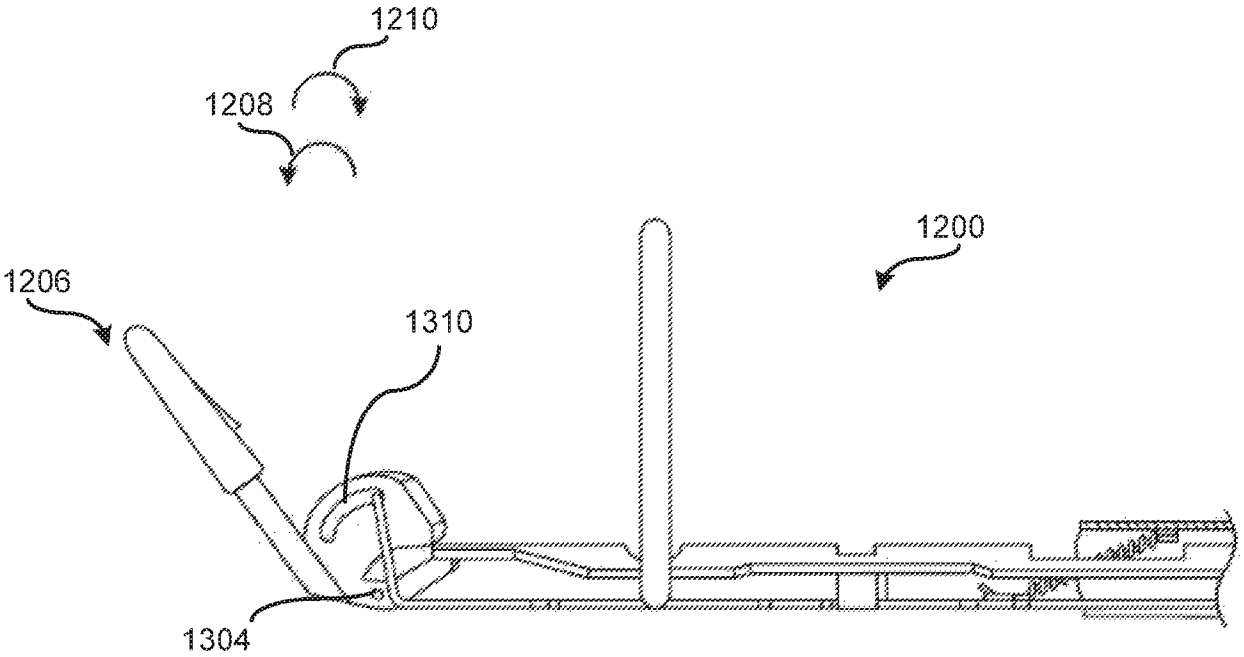
Figure 18:
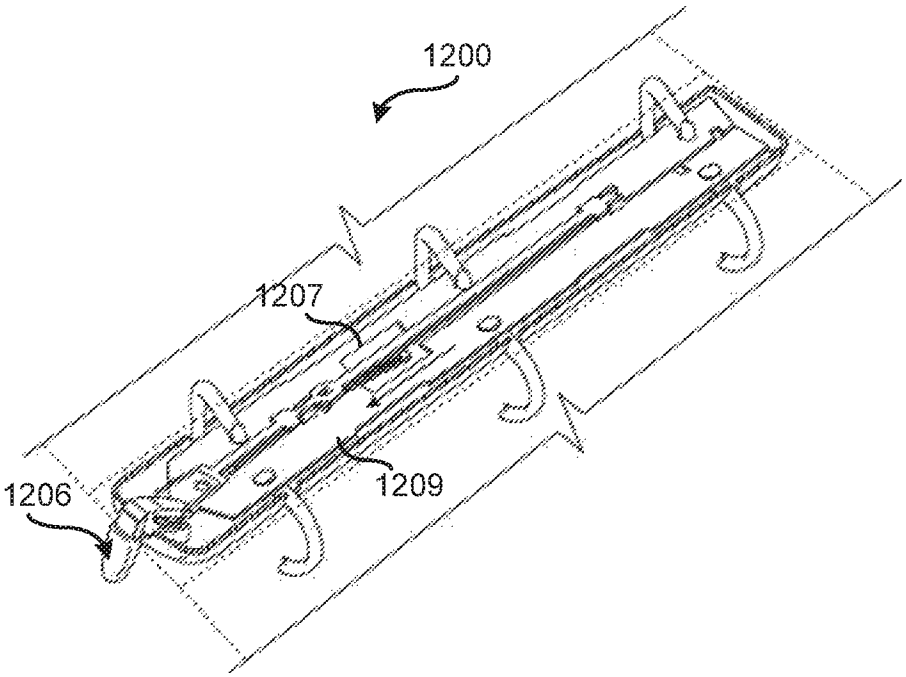
Figure 19:
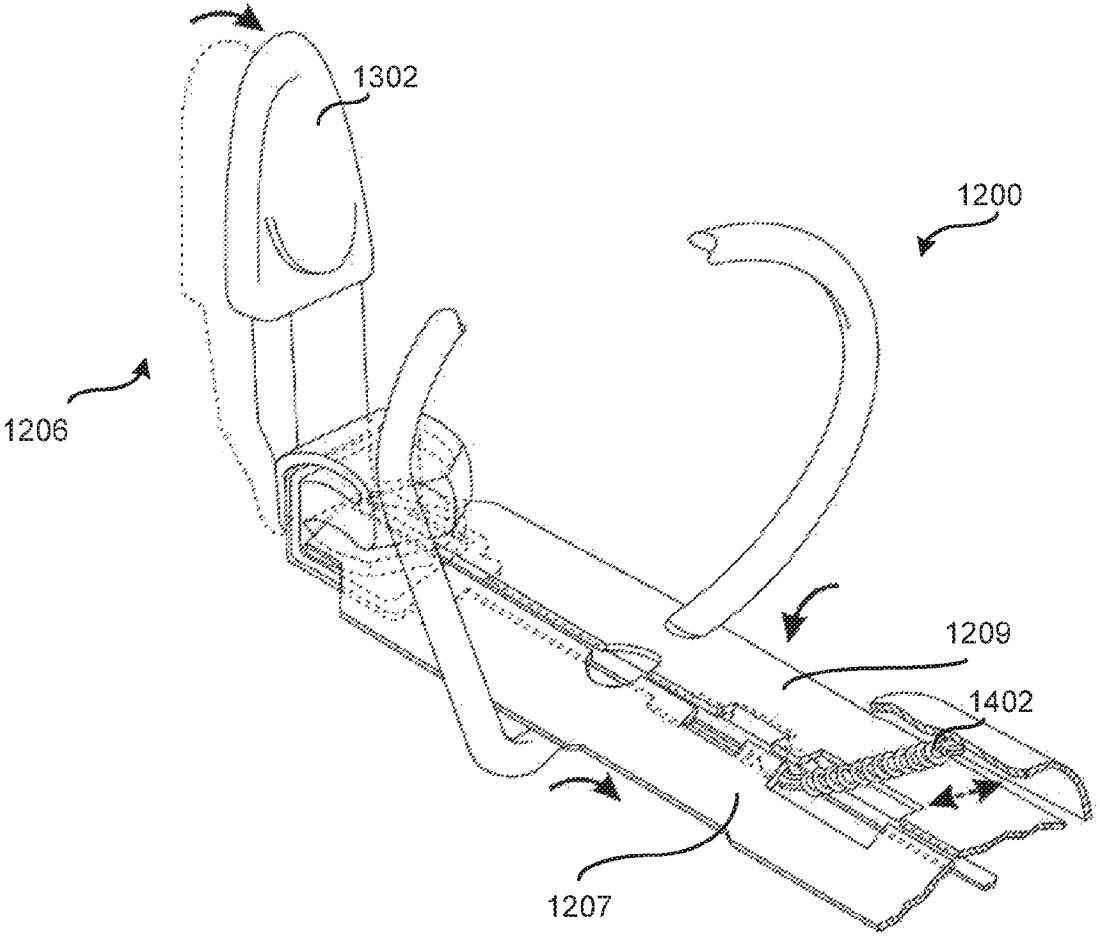
FIGS. 19-21 depict the example binder apparatus of FIG. 12 being transition from the open position toward the closed position.
Figure 20:
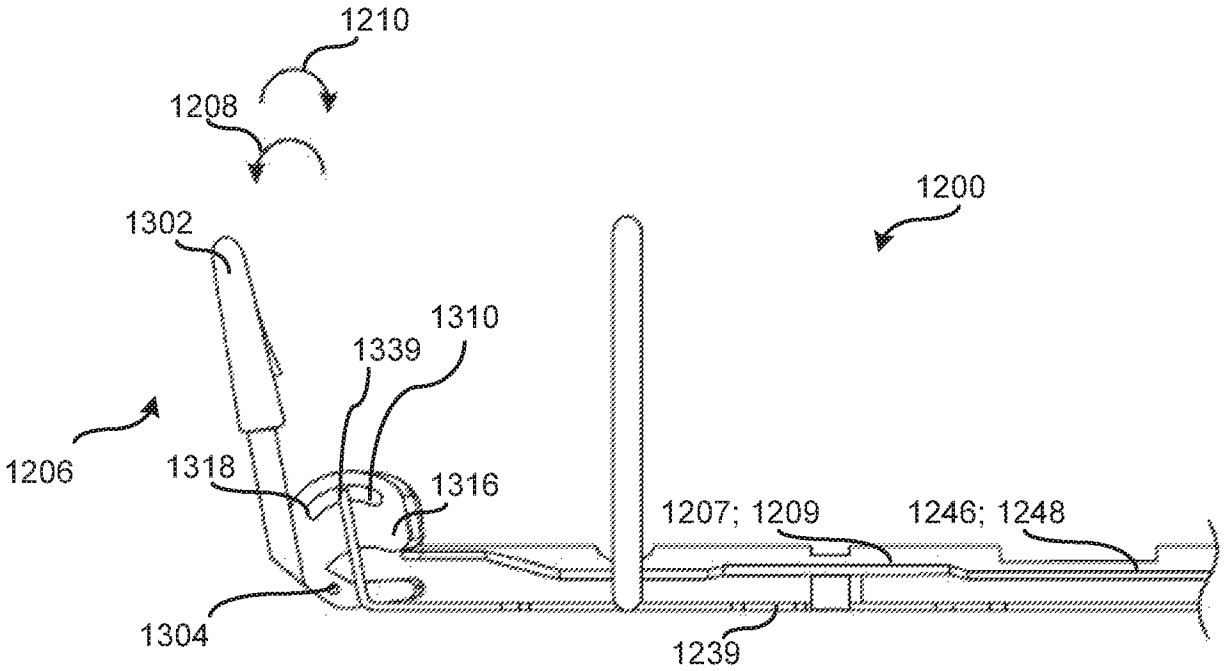
Figure 21:
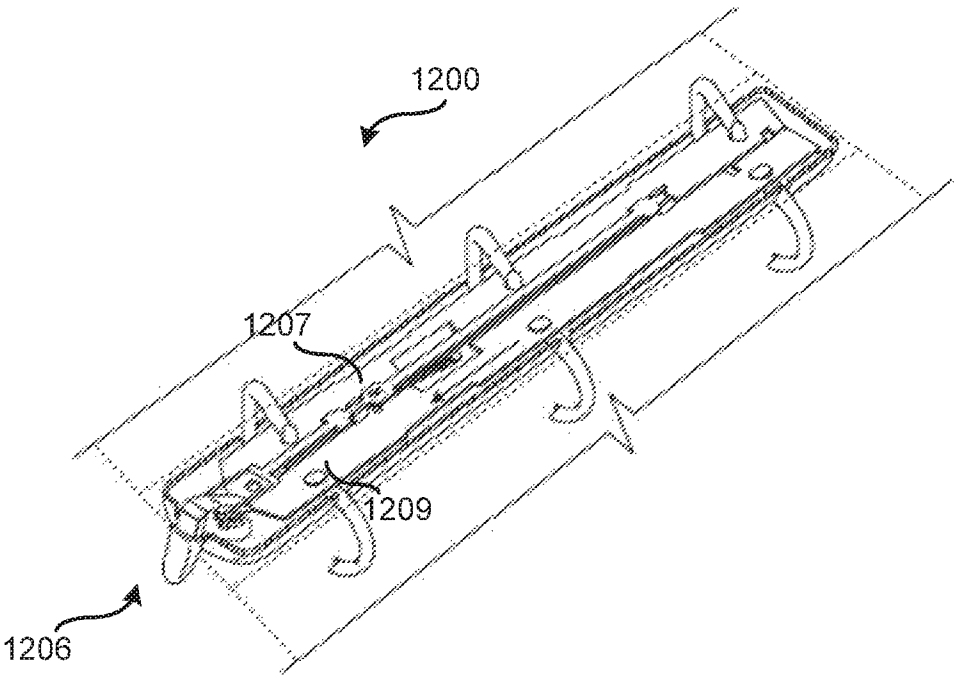
Figure 22:
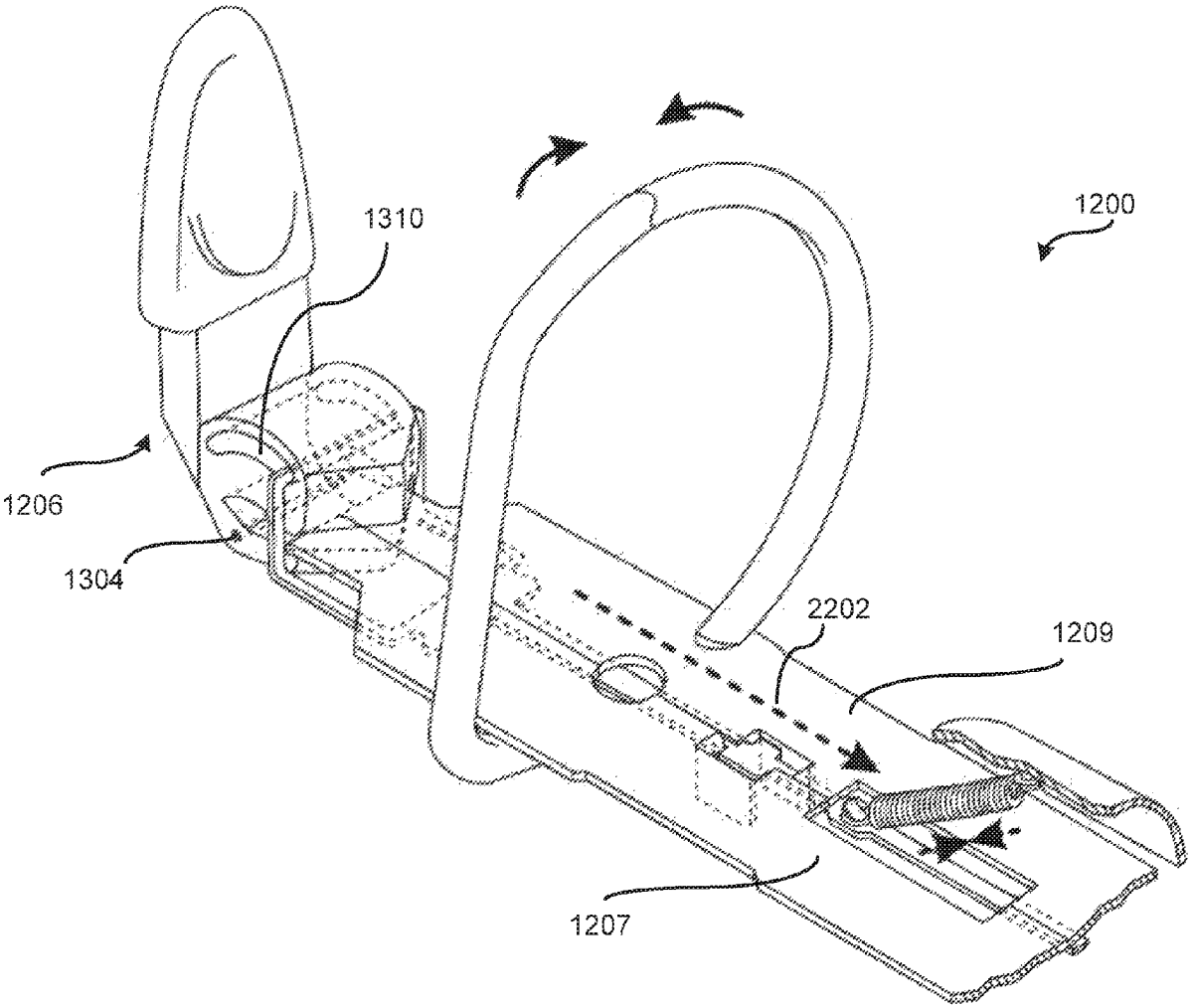
FIGS. 22-24 depict the example binder of FIG. 12 in the closed position.
Figure 23:
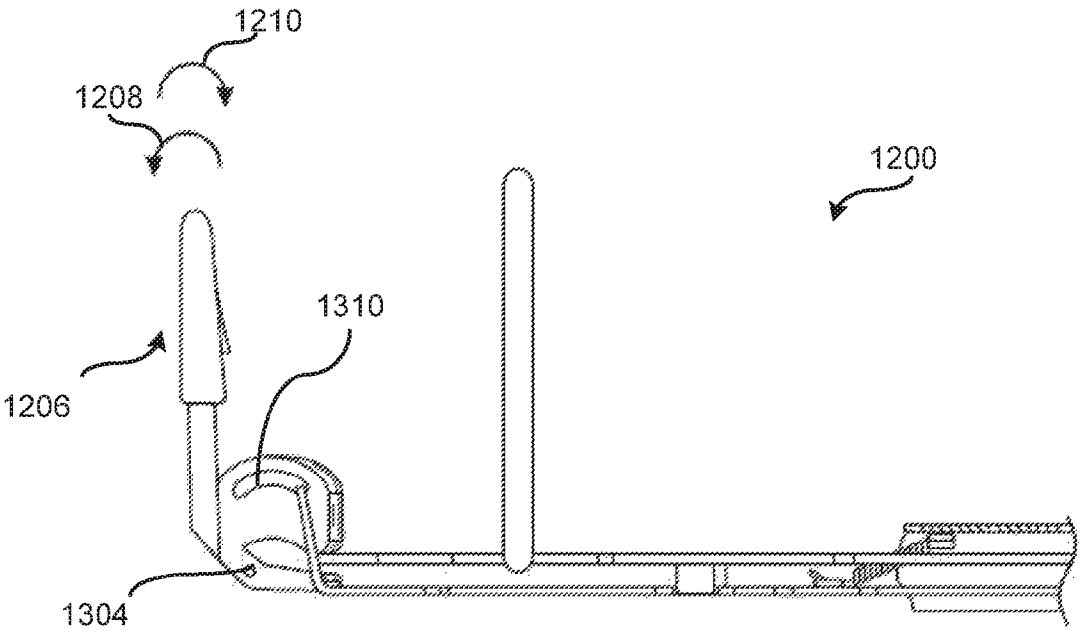
Figure 24:
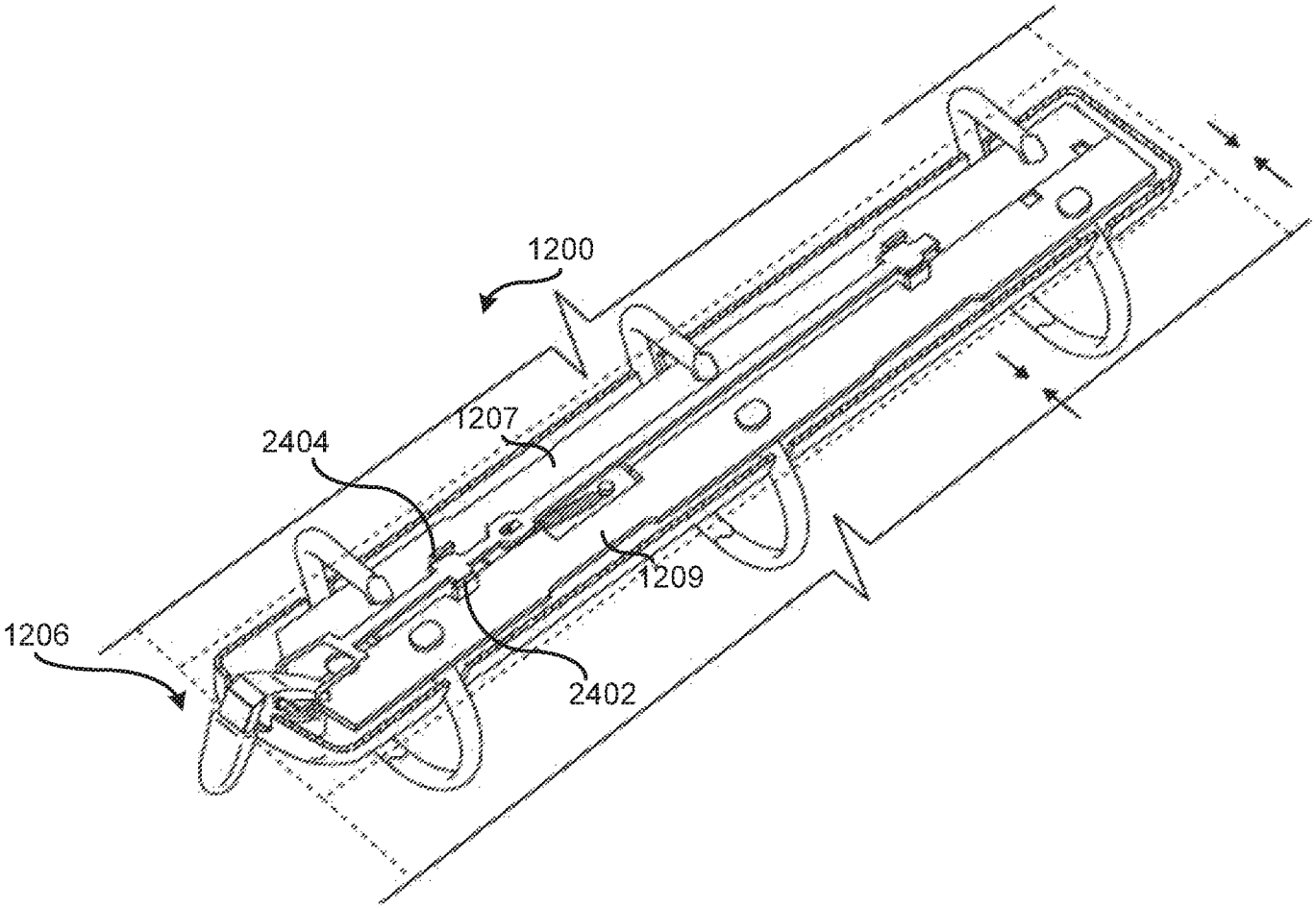
Figure 25:
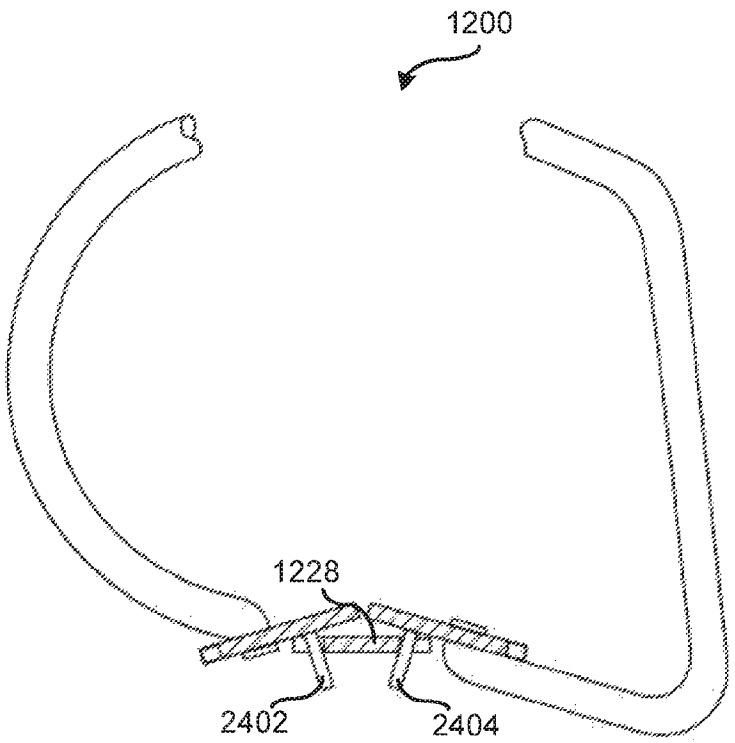
FIGS. 25-27 depict the example binder apparatus of FIG. 12 in the open position.
Figure 26:
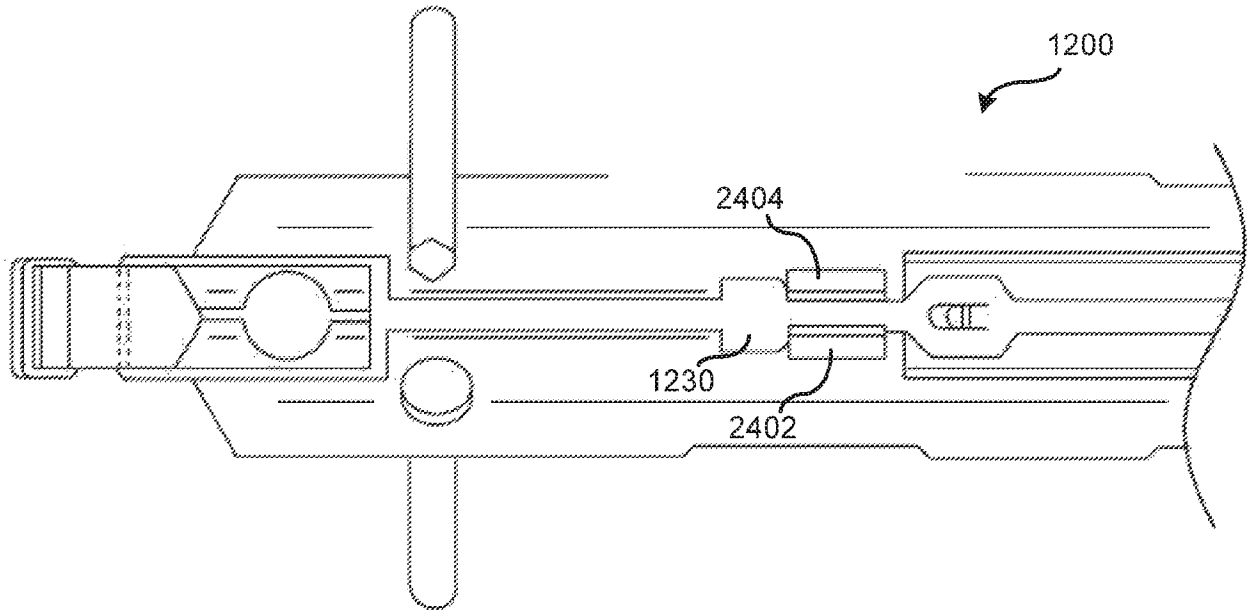
Figure 27:
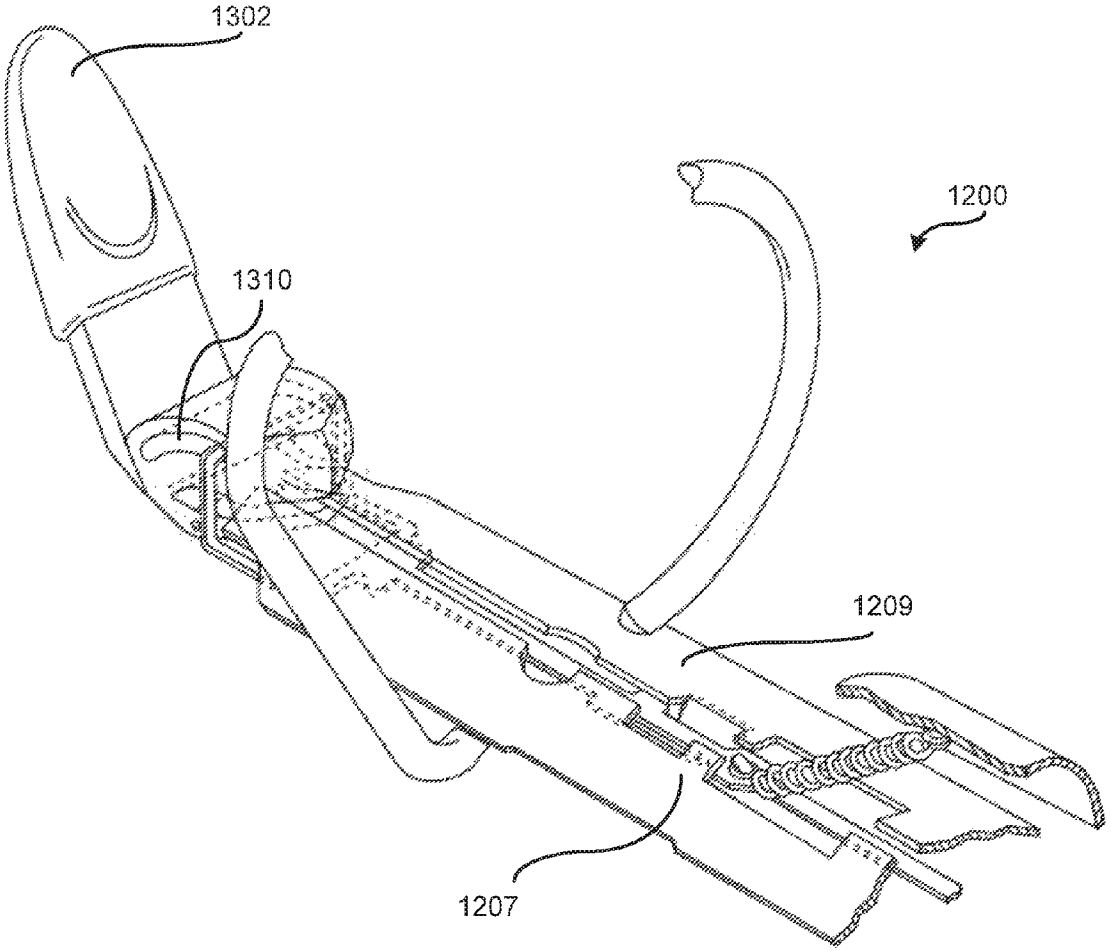

FIGS. 13-15 depict the binder 1200 in the closed position. FIGS. 16-18 depict the binder 1200 being transitioned from the closed position to the open position. FIGS. 19-21 depict the binder 1200 being transition from the open position toward the closed position. FIGS. 22-24 depict the binder 1200 in the closed position. FIGS. 25-27 depict the binder 1200 in the open position.

In operation, to open the binder 1200 as shown in FIGS. 13-18, the handle 1302 is moved in a direction generally indicated by the arrow 1208, thereby moving a first end 1312 of the beak 1306 toward outward facing surfaces 1242, 1244 of the carrier rails 1207, 1209. When the first end 1312 begins to transition the carrier rails 1207, 1209 from the closed position to the open position, the travel bar end 1239 is positioned adjacent a leading edge and/or surface 1314 of the channel 1310. As the handle 1302 is further pivoted in the direction generally indicated by arrow 1208, the travel bar 1228 and its locking elements 1230 are moved and/or transitioned toward an unblocking position. Specifically, the locking elements 1208 are moved via the longitudinal movement of the travel bar 1228 to enable and/or not block the carrier rails 1207, 1209 from pivoting toward the open position.

To close the binder 1200 as shown in FIGS. 19-24, the handle 1302 is moved in a direction generally indicated by arrow 1210, thereby moving a second end 1316 of the beak 1306 toward inward facing surfaces 1246, 1248 of the carrier rails 1207, 1209. In some examples, the channel 1310 is sized and/or has a length to enable the second end 1316 to engage and transition the carrier rails 1207, 1209 toward the closed position prior to the travel bar end 1239 engaging a trailing edge 1318 of the channel 1310 and/or while the travel bar end 1239 moves within the channel 1310. Thus, the carrier rails 1207, 1209 may be transitioned from the open position toward the closed position while the travel bar 1228 remains in the unlocked and/or non-blocking position. After the travel bar end 1239 engages the trailing edge 1318, in some examples, further movement of the handle 1302 in the direction generally indicated by arrow 1210 moves and/or transitions the travel bar 1228 and the locking elements 1230 toward the blocking position. Additionally or alternatively, in some examples, the travel bar 1228 is biased via a spring and/or biasing apparatus 1402 in a direction generally indicated by arrow 2202 (FIG. 22). In some such examples, once the carrier rails 1207, 1209 are transitioned enough to provide adequate space between the travel bar 1228 and the carrier rails 1207, 1209 to enable the locking elements 1230 to be transitioned to the locking position between locking, protruding tabs 2402, 2404 (FIG. 24), the spring 1402 moves the travel bar 1228 toward and/or into the locking position. In the blocking position, the locking elements 1230 may be positioned between the locking tabs 2402, 2404 (FIG. 24) of the carrier rails 1207 and/or 1209 to substantially prevent the binder 100 from opening.

Figure 28:
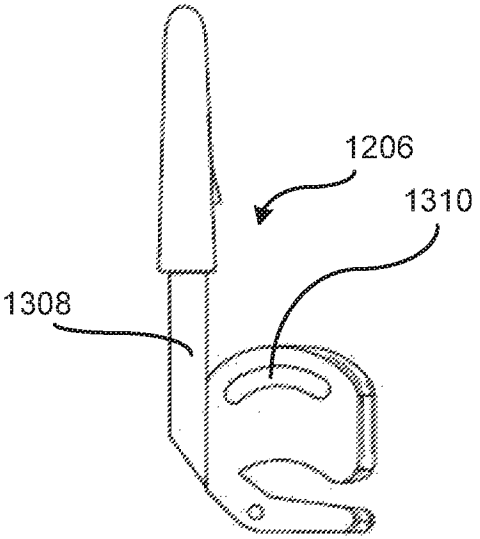
FIG. 28 depicts a perspective view of an example lever that can be used to implement the examples disclosed herein.
Figure 29:
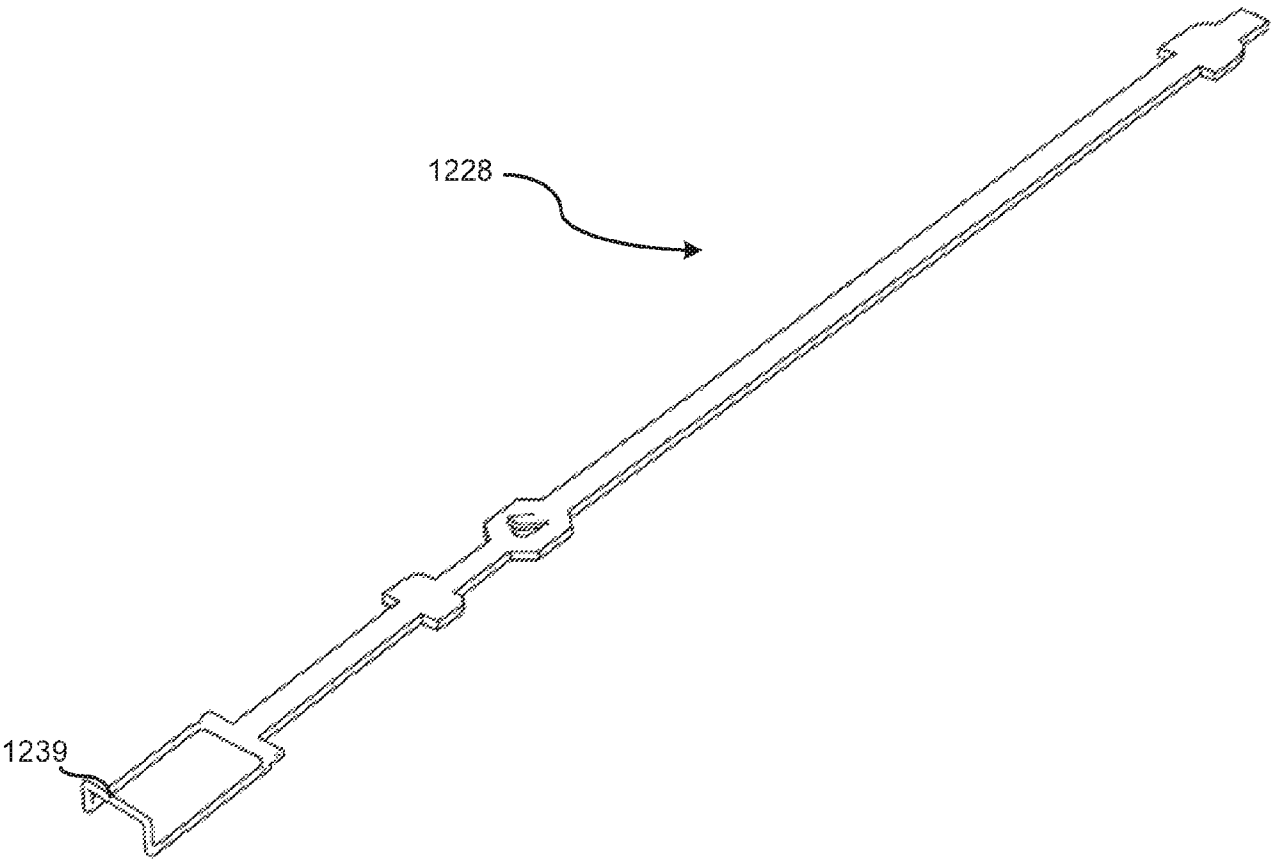
FIG. 29 depicts an example travel bar that can be used to implement the examples disclosed herein.

FIG. 25 depicts an end view of the example binder 1200 and the interaction between the travel bar 1228 and the locking tabs 2402, 2404 of the carrier rails 1207, 1209. FIG. 26 depicts the binder 1200 in the open position and the locking elements 1230 spaced from and/or not positioned between the locking tabs 2402, 2404. FIG. 28 depicts an isometric view of the example lever 1206 and FIG. 29 depicts an isometric view of the travel bar 1228.

Furthermore, although certain example methods, apparatus and articles of manufacture have been described herein, the scope of coverage of this patent is not limited thereto. On the contrary, this patent covers all methods, apparatus and articles of manufacture fairly falling under the doctrine of equivalents.

What is claimed is:

1. A binder apparatus, comprising:

a housing;

first and second carrier rails supported by the housing;

a slider movable between a first position and a second position, where (a) in the first position, the slider secures the first and second carrier rails in a closed position, and (b) in the second position, the slider enables pivotable movement of the first and second carrier rails; and a lever to pivot the first carrier rail and the second carrier rail between the closed position and the open position, the lever including a groove and a channel, the groove to receive a portion of the first and second carrier rails, the channel to receive an end of the slider, the end of the slider to move unobstructedly within the channel to delay movement of the slider when the lever pivots the first and second carrier rails from the open position toward the closed position.

2. The binder apparatus of claim 1, wherein, when the lever is moved from a third position toward a fourth position, the end of the slider substantially immediately engages a first surface adjacent a first end of the channel to move the slider from the first position to the second position and enable the first and second carrier rails to be pivoted from the closed position to the open position.

3. The binder apparatus of claim 2, wherein, when the lever is moved from the fourth position toward the third position, the end of the slider travels within the channel from the first end toward a second surface adjacent a second end of the channel to enable the first and second carrier rails to be at least partially transitioned from the open position to the closed position prior to the slider being moved from the second position to the first position.

4. The binder apparatus of claim 1, wherein the channel includes an arc-shaped channel.

5. The binder apparatus of claim 1, wherein the channel extends entirely through the lever.

6. The binder apparatus of claim 1, further including ring portions coupled along the first and second carrier rails, in the closed position, respective ring portions engage to form a closure.

7. The binder apparatus of claim 1, further including a locking element coupled to the slider, in the closed position, the slider to position the locking element between the carrier rails and the housing or between the carrier rails to secure the first and second carrier rails in the closed position.

8. The binder apparatus of claim 1, wherein the slider is to be positioned in a groove formed by tabs of the first and second carrier rails to guide movement of the slider relative to the first and second carrier rails.

9. The binder apparatus of claim 8, further including a locking element coupled to the slider, wherein in the first position, the locking element to be positioned between the tabs to secure the first and second carrier rails in a closed position.

10. The binder apparatus of claim 8, further including a locking element coupled to the slider, wherein in the second position, the locking element is spaced from between the tabs.

11. The binder apparatus of claim 1, wherein the slider is directly coupled to the lever.

12. A binder apparatus, comprising:

a housing;

first and second carrier rails supported by the housing;

a slider movable between a first position and a second position, where (a) in the first position, the slider secures the first and second carrier rails in a closed position, and (b) in the second position, the slider enables pivotable movement of the first and second carrier rails;

a lever to pivot the first carrier rail and the second carrier rail between the closed position and the open position, the lever including a groove and a channel, the groove to receive a portion of the first and second carrier rails, the channel to receive an end of the slider, the end of the slider to move within the channel to delay movement of the slider when the lever pivots the first and second carrier rails from the open position toward the closed position; and a biasing element coupled between the housing and the slider to urge the slider toward the closed position.

13. A binder apparatus, comprising:

a housing;

first and second carrier rails supported by the housing;

a slider movable between a first position and a second position, where (a) in the first position, the slider secures the first and second carrier rails in a closed position, and (b) in the second position, the slider enables pivotable movement of the first and second carrier rails; and a lever to pivot the first carrier rail and the second carrier rail between the closed position and the open position, the lever including means for delaying movement of the slider by enabling the slider to move unobstructedly relative to the lever when the lever pivots the first and second carrier rails from the open position toward the closed position.

14. The binder apparatus of claim 13, wherein the means for delaying movement of the slider includes a channel to receive an end of the slider, the end of the slider to move unobstructedly within the channel to delay the movement of the slider when the lever pivots the first and second carrier rails from the open position toward the closed position.

15. The binder apparatus of claim 13, further including a biasing element to urge the slider toward the closed position.

16. The binder apparatus of claim 15, wherein the biasing element is coupled between the housing and the slider.

17. The binder apparatus of claim 13, wherein the slider is to be positioned in a groove formed by tabs of the first and second carrier rails to guide movement of the slider relative to the first and second carrier rails.

18. The binder apparatus of claim 13, wherein the lever includes means for enabling substantially simultaneous movement of the slider and the first and second carrier rails when the lever pivots the first and second carrier rails from the closed position toward the open position.

19. The binder apparatus of claim 18, wherein the means for enabling substantially simultaneous movement of the slider and the first and second carrier rails includes a channel to receive an end of the slider.

20. The binder apparatus of claim 13, wherein the slider is directly coupled to the lever.

* * * * *